US007686537B2

(12) United States Patent
Mullett

(10) Patent No.: US 7,686,537 B2
(45) Date of Patent: Mar. 30, 2010

(54) ROAD GRADER/SPREADER

(75) Inventor: Myron L. Mullett, P.O. Box 322, Westcliffe, CO (US) 81252

(73) Assignee: Myron L. Mullett, Westcliffe, CO (US)

( * ) Notice: Subject to any disclaimer, the term of this patent is extended or adjusted under 35 U.S.C. 154(b) by 795 days.

(21) Appl. No.: 11/397,399

(22) Filed: Apr. 5, 2006

(65) Prior Publication Data

US 2007/0235202 A1 Oct. 11, 2007

(51) Int. Cl.
*E01C 19/12* (2006.01)

(52) U.S. Cl. ..... 404/101; 404/105; 404/96; 172/253; 172/810

(58) Field of Classification Search ..... 172/788, 172/799.5, 253, 810, 811; 404/104, 105, 404/110, 101, 96; 37/270, 271, 274, 281
See application file for complete search history.

(56) References Cited

U.S. PATENT DOCUMENTS

| | | | | | |
|---|---|---|---|---|---|
| 1,488,857 | A * | 4/1924 | Arndt | 404/110 |
| 2,794,274 | A * | 6/1957 | Robinson | 172/786 |
| 2,948,202 | A * | 8/1960 | Millikin | 404/119 |
| 3,011,275 | A * | 12/1961 | White, Jr. | 172/781 |
| 3,091,999 | A * | 6/1963 | MacDonald | 404/101 |
| 3,359,875 | A * | 12/1967 | Reider | 404/75 |
| 3,680,451 | A * | 8/1972 | Birtchet | 404/104 |
| 3,957,384 | A * | 5/1976 | Lamb et al. | 404/118 |
| 4,201,000 | A * | 5/1980 | Stanford | 37/407 |
| 4,320,988 | A | 3/1982 | Seal | |
| 4,329,081 | A * | 5/1982 | Buvik | 404/110 |
| 4,395,156 | A * | 7/1983 | Sprague, III | 404/110 |
| 4,655,297 | A | 4/1987 | Bourgeois, Jr. | |
| 4,678,365 | A | 7/1987 | Ban et al. | |
| 4,871,025 | A * | 10/1989 | Mayfield et al. | 172/4.5 |
| 5,096,331 | A * | 3/1992 | Raymond | 404/118 |
| 5,191,943 | A | 3/1993 | Minor et al. | |
| 5,201,603 | A * | 4/1993 | Bassett et al. | 404/84.1 |
| 5,397,200 | A | 3/1995 | Seal | |
| 5,724,755 | A * | 3/1998 | Weagley | 37/233 |
| 5,806,607 | A * | 9/1998 | Sanders | 172/253 |
| 6,056,475 | A * | 5/2000 | Peterick et al. | 404/119 |
| 6,171,020 | B1 * | 1/2001 | Pikna et al. | 404/121 |
| 6,425,196 | B1 | 7/2002 | Weagley et al. | |
| 6,560,904 | B2 * | 5/2003 | Guggino | 37/233 |
| 6,923,594 | B2 * | 8/2005 | Sovik et al. | 404/96 |

(Continued)

*Primary Examiner*—Robert E Pezzuto
*Assistant Examiner*—Matthew D Troutman
(74) *Attorney, Agent, or Firm*—Dale B. Halling

(57) ABSTRACT

A road grader comprising an elongated grader blade adapted to be pushed by a vehicle such as a bulldozer and having mutually parallel side members attached to the lateral ends of the blade perpendicularly to the blade's longitudinal axis, each of said side members comprising a pair of spaced apart walls that house a slidable mounting plate on the lower end of which is attached a ground contacting skid. Each slidable mounting plate is separately actuated to move upwardly or downwardly with respect to the side member in which it is housed. Relative upward or downward movement of the side member, with respect to the ground contacting skid, results in lowering or elevating the respective ends of the grader blade with respect to the level of the respective ground contacting skid. Separately adjusting the height of the lateral ends of the grader blade and driving the blade by a pushing vehicle permits the precision depth application of a layer of road material at any desired angle or tilt.

8 Claims, 3 Drawing Sheets

U.S. PATENT DOCUMENTS 7,121,763 B1 * 10/2006 Young et al. ..... 404/118
7,255,512 B2 * 8/2007 Wallace ..... 404/83
7,261,491 B2 * 8/2007 Rahn et al. ..... 404/104
2005/0229437 A1 * 10/2005 Nesseth ..... 37/281

* cited by examiner

ROAD GRADER/SPREADER

FIELD OF THE INVENTION

The present invention relates to apparatus for grading and spreading road building materials.

BACKGROUND OF THE INVENTION

The prior art reveals a considerable number of devices designed to spread materials over the ground or over existing layers of material where it is desirable to obtain a finished grade. All of the known apparatus of this kind are towable behind a tractor or similar vehicle. Such a device is disclosed in U.S. Pat. No. 6,308,785 to Rhoden, issued Oct. 30, 2001.

Machines similar to the Rhoden grader/spreader are satisfactory for their intended agricultural purposes but have limitations when applying and spreading materials for road and highway construction. The depth or thickness of layers of gravel and other materials that comprise a road or highway are carefully specified by the design engineers. In many cases the depth requirement is a minimum figure and unintended deposition of a greater amount of material is wasteful and overly expensive. For example, many excess cubic yards of material would be consumed if one inch of material in excess of the specification is applied to a multi-mile roadway thirty feet wide.

When a grader/spreader is pulled by a vehicle it can be assumed that the towing vehicle is going to traverse surface variations that are going to cause the grader/spreader to undulate in response to the pitching motions of the towing vehicle. Where the work is being done to construct or resurface a road or highway the rising and falling movement of the grader results in an uneven surface on the material being spread, together with significant departures from the design specification. Agricultural endeavors do not require the grader precision that must be present in road and highway work.

Accordingly, it is an object of the present invention to provide a grader/spreader that is pushed by a vehicle that runs on the graded surface provided by the grader/spreader it is pushing.

Another object of the invention is to provide a grader whose blade elevation and grading angle is adjustable by the operator of the vehicle that is pushing the grader.

Other objects, features and advantages of the grader of the present invention will become apparent upon a reading the following specification taken in conjunction with the attached drawings.

SUMMARY OF THE INVENTION

The present invention is a road grader having an elongated blade with mutually parallel side members attached to the lateral ends of the blade where each of the side members comprise a pair of spaced apart walls that house a plate movable in an up and down direction within the side member. Each of the movable plates is attached at its lower edge to a ground contacting skid. A hydraulic piston or similar reciprocating device interconnects each side member with its respective interior plate for moving the plate up and down within the side housing member in order to raise or lower the skid that is attached to the movable plate. Up and down movement of the skids with respect to the side members that are attached to the blade results in selective positioning of each end of the blade so their respective elevations above the grade on which the skid rests will result in a precise depth and slope of the material that is being spread.

DETAILED DESCRIPTION OF PREFERRED EMBODIMENT

Figure 1:
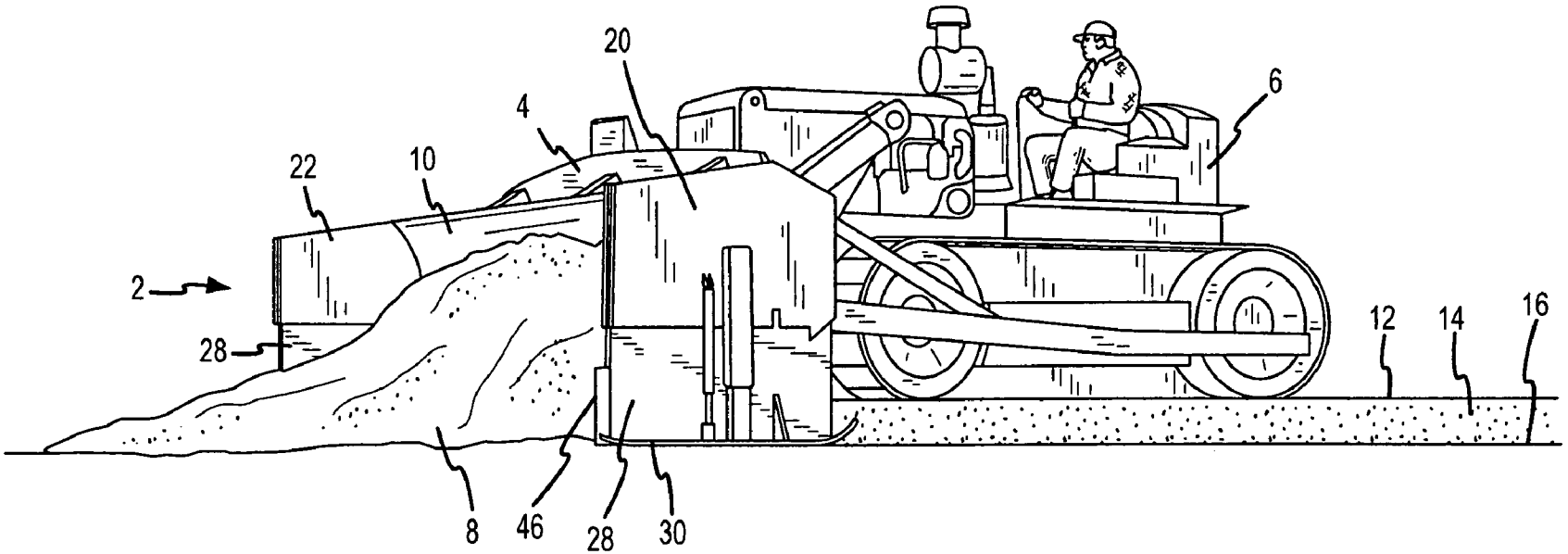
FIG. 1 is a perspective view of a bulldozer pushing the grader/spreader of the present invention.

The grader/spreader 2 of the present invention is shown in FIG. 1 as mounted on and carried by the front blade 4 of a bulldozer 6 is spreading gravel 8 to a specified layer depth. Prior to spreading the gravel is piled in front of the blade 10 of the grader/spreader 2. The bulldozer operates on top of the finished grade 12 of the gravel, or other material that is being spread, thereby assuring a level and constantly accurate depth of the layer 14.

The depth of the layer 14 above the base grade 16 is controlled by the elevation of the bottom edge of the blade 10 above the base grade. The elevation of each lateral end of the blade 10 may be independently set by hydraulic controls in the cockpit of the bulldozer. This selective adjustment of the height of the blade allows the grade to be sloped from right to left or left to right, with equal height of each blade end resulting in a level grade.

Figure 2A:
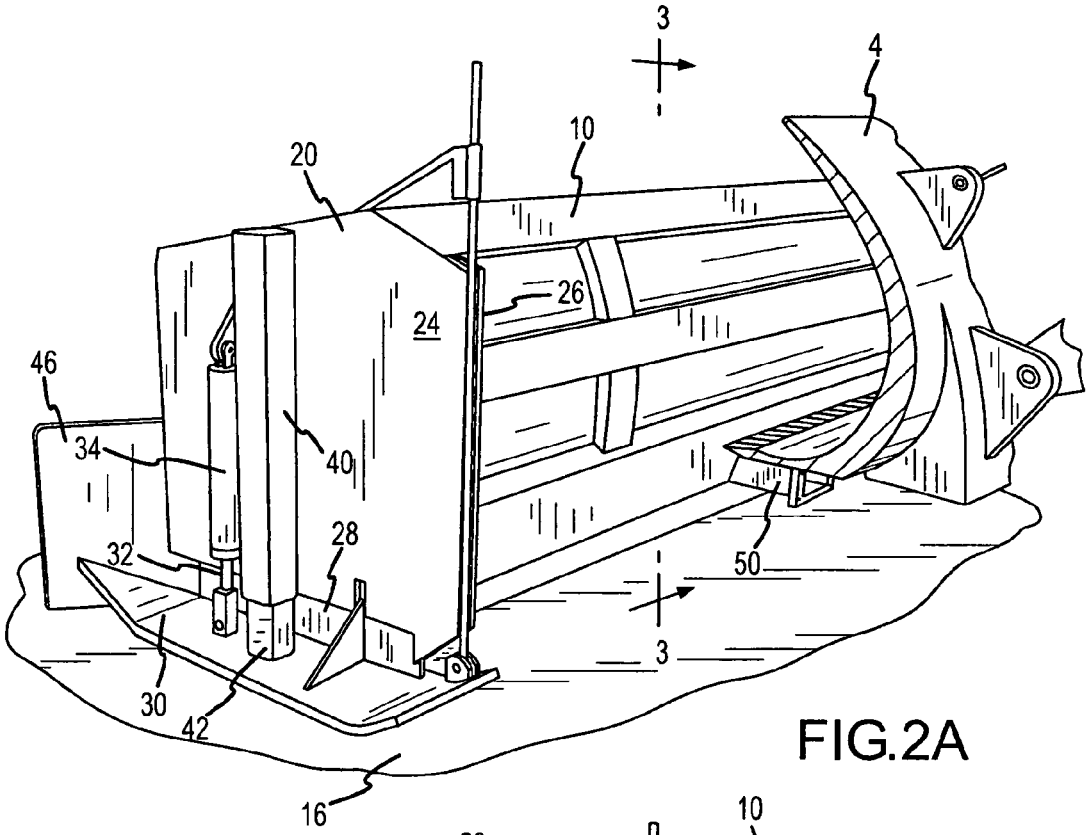
FIG. 2A is a rear perspective view of the grader blade of the present invention showing in cross section a fragmentary view of the bulldozer blade that mounts the grader blade. The illustrated left side skid is shown in the retracted position that allows the left end of the grader blade to be at essentially the same level as the skid.
Figure 2B:
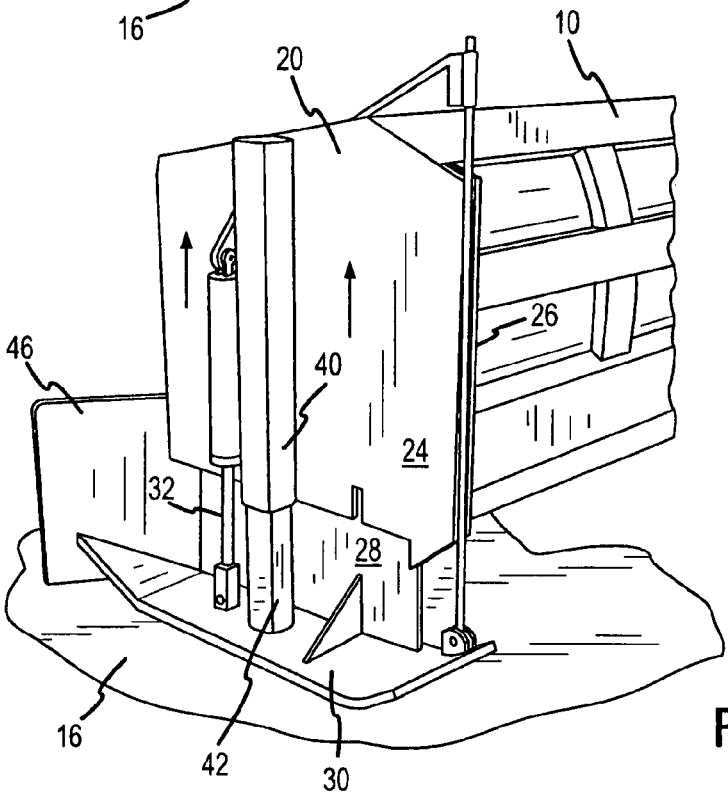
FIG. 2B is a fragmentary perspective view of the grader blade with the illustrated left end of the blade raised above the level of the left side skid.

The novel apparatus for selective adjustment of the height of the blade ends is illustrated in FIGS. 2A and 2B. To the lateral ends of the grader blade 10 there are attached side members 20 and 22. Each of the side members includes a pair of spaced apart steel panels 24 and 26 between which is disposed a plate 28 that is slidable in an up and down direction. The bottom edge of the plate 28 is secured to a flat skid 30 that is adapted to run along the base grade 18 of the roadway being worked on. To provide the force necessary to slide the plate 28 between the panels comprising each of the end members and thus raise or lower the skid 30, a hydraulic piston 32 is provided. One end of the piston is attached to the skid 30 while the other end of the piston is housed within the hydraulic cylinder 34 that is attached to the side of the outside side member panel 24. The hydraulic piston and cylinder are conventional in their construction and are operated by the pressure of hydraulic fluid controlled by valves located in the cockpit of the bulldozer and hydraulic lines interconnecting the cylinder 34 and the cockpit controls (not shown). Appropriate application of the hydraulic controls will cause the piston 32 to extend out of the cylinder 34 and force the movable plate 28 downwardly and partially out of the side member housing 20. This movement of the plate 28 causes the end member 20 and the left end of the blade 10 to be raised with respect to the skid 30 (FIG. 2B). With opposite adjustment of the hydraulic controls the piston 32 is made to retract into the cylinder 34, thus lowering the elevation of the blade 10 with respect to the skid 30 (FIG. 2A). While hydraulic apparatus is the preferred form of motive force, other well known means may be employed to move the plates 28 within the confines of the housing panels 24 and 26 of the side members 20 and 22.

While a single hydraulic piston may be sufficient to supply the power to raise and lower the blade end, a single piston may be structurally unstable. To overcome the instability a tubular sleeve 40 is attached to the outside side member panel 24 and the distal end of a slidable insert 42 is attached to the skid 30. Thus, while the hydraulic piston and cylinder are supplying the necessary force to move the plate 28 within the end member, the sleeve and slidable insert supply the required structural stability between the movable members.

To ensure that the skid 30 remains in solid contact with the base grade 16 an auxiliary plow 46 is angularly attached to the front of each skid 30. The plow is angled inwardly toward the blade 10 so that the material being spread will not collect in front of the skid 30 so as to pass beneath the skid and upset the precision of the height adjustment of the blade 10.

Figure 3:
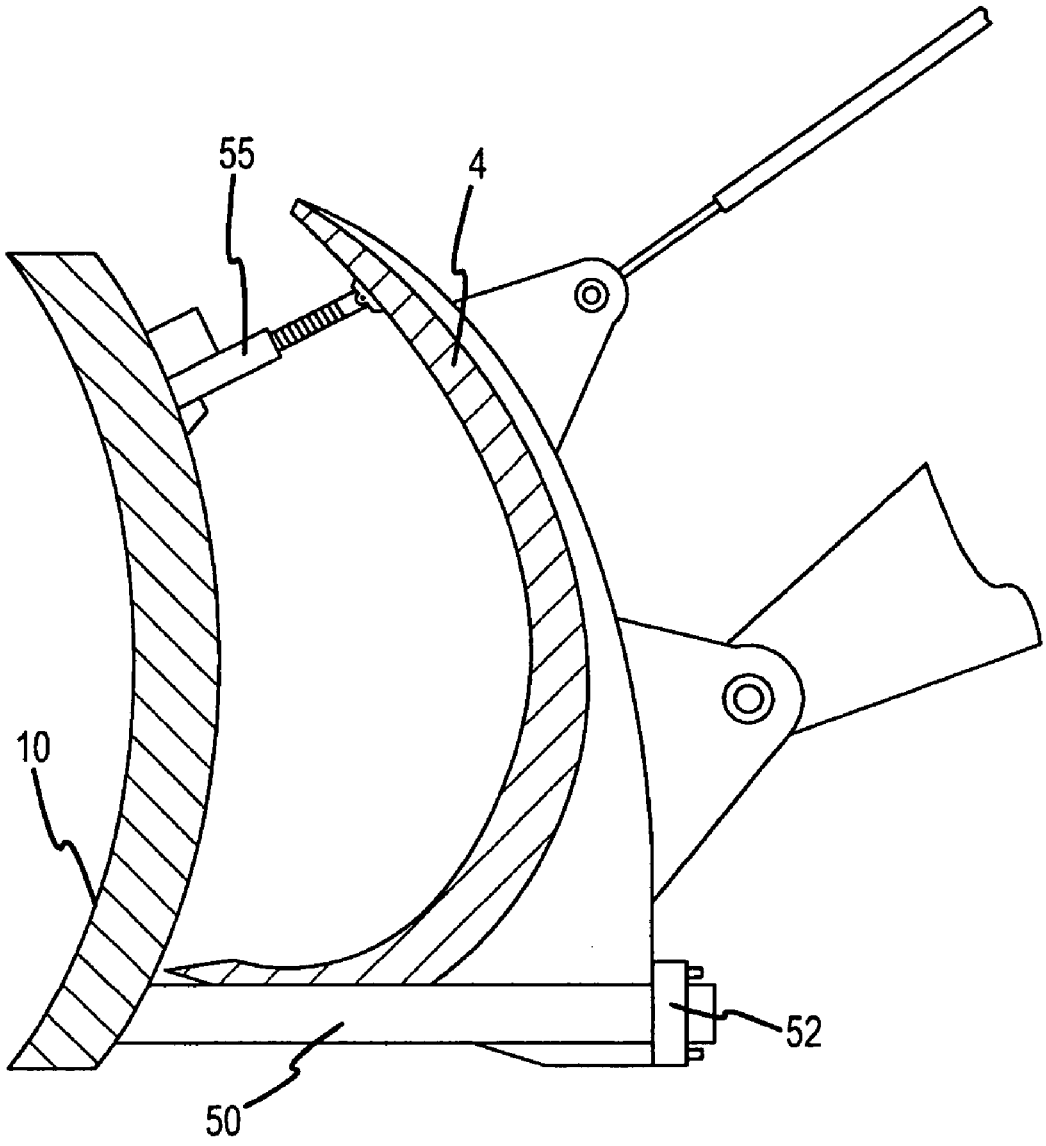
FIG. 3 is a cross sectional view taken along lines 3-3 in FIG. 2A.

As seen in FIGS. 2A and 3 the bottom of the bulldozer blade 4 rests on the top surface of a pair of rearwardly protruding brackets 50. Preferably a stop 52 carried by the bracket is screwed against the back of the bulldozer blade 4 to hold the bulldozer blade in place against the grader blade 10. Between the top portion of the bulldozer blade and the top of the back side of the grader blade a jack screw 55 provides a compression connection between the two blades. Adjustment of the jack screw operates to establish the tilt of the grader blade.

What is claimed is:

1. A road grader mounted to a bulldozer blade and being pushed by a bulldozer comprising:

the bulldozer having the bulldozer blade, an elongated grader blade having a horizontal longitudinal axis and front and back sides with lateral ends, the elongated grader blade mounted to the bulldozer blade, wherein the elongated grader blade is pushed by the bulldozer, two mutually parallel side members attached to the respective lateral ends of the grader blade perpendicularly to the grader blade's longitudinal axis, each of said side members comprising a pair of spaced apart walls, a mounting plate having a lower edge and being slidably disposed between the spaced apart walls in each side member, ground contacting skids riding on a base grade each having forward and rear ends and a longitudinal axis, said skids attached respectively to the lower edges of the mounting plates where the longitudinal axis of each skid is perpendicularly oriented to the longitudinal axis of the grader blade, reciprocating means interconnecting each side member with its respective mounting plate ground contacting skid for moving the mounting plate and skid up and down within the side member, at least two rearwardly extending brackets disposed on the back side of the grader blade for supporting the bulldozer blade, and at least one adjustable length pressure rod extending rearwardly from the back side of the grader blade in contact with a front surface of the bulldozer blade thereby defining a pitch of the grader blade.

2. The assembly of claim 1 and further including a plow plate attached to the forward end of each skid and disposed at an angle to the longitudinal axis of the skid.

3. The assembly of claim 2 and further including stabilizing means interconnecting each side member with its respective reciprocating means skid.

4. A road grading blade assembly mounted to a bulldozer blade and being pushed by a bulldozer comprising, the bulldozer having the bulldozer blade, a grader blade having lateral ends and having a plurality of rearward protruding brackets disposed on the back side of the grader blade on which the bulldozer blade sits, a pair of screws disposed on the back side of the grader blade in contact with a front surface of the bulldozer blade, defining a pitch of the grader blade, housing means secured to each lateral end of the grader blade for holding a sliding plate member, a sliding plate having a bottom edge and disposed within each of the housing means for up and down slidable movement therein, a ground contacting skid riding on a base grade having forward and rear ends and attached to the bottom edge of each sliding plate, hydraulic piston and cylinder means interconnecting each housing and its respective sliding plate/skid combination for providing up and down movement of the skid, wherein the grader blade is pushed by the bulldozer.

5. The combination of claim 4 and further including, a tubular sleeve attached to each of said lateral housing means, an elongated insert having a bottom end and slidably disposed within each of the tubular sleeves, said bottom end of the insert being attached to the skid associated with the housing means.

6. The combination of claim 4 and further including, a plow plate angularly attached to the forward end of each skid.

7. The combination of claim 4 and further including, a depth gauge comprising, a cylindrical tube attached to at least one of the housing means, and a depth indicator rod having upper and lower ends and slidably disposed within the cylindrical tube where the lower end of the rod is connected to the skid associated with the housing means.

8. A road grading blade assembly mounted to a bulldozer blade and being pushed by a bulldozer comprising, the bulldozer having the bulldozer blade, a grader blade having lateral ends and having a plurality of rearward protruding brackets disposed on the back side of the grader blade on which the front blade sits, a pair of screws disposed on the back side of the grader blade in contact with a front surface of the bulldozer blade, defining a pitch of the grader blade, an enclosure attached to each of the lateral ends of the grader blade, a plate slidably disposed within each of said enclosures, said plates each having a bottom edge, a ground contacting skid riding on a base grade attached to the bottom edge of each plate, said skid having forward and rearward ends, a plow plate angularly disposed on the forward end of each skid, and hydraulic piston means interconnecting each of the enclosures with its respective skid for raising and lowering the skid, wherein the grader blade is pushed by the bulldozer.

* * * * *